US007282871B1

(12) United States Patent
Kim et al.

(10) Patent No.: US 7,282,871 B1
(45) Date of Patent: Oct. 16, 2007

(54) BACKLIGHT INVERTER FOR INDUCTIVELY DETECTING CURRENT

(75) Inventors: Jong Rak Kim, Kyungki-do (KR); Hoy Young Kim, Kyungki-do (KR); Jung Heyn Park, Cheonlabook-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 11/458,946

(22) Filed: Jul. 20, 2006

(30) Foreign Application Priority Data

Jul. 5, 2006 (KR) ..... 10-2006-0062943

(51) Int. Cl.
*G05F 1/00* (2006.01)

(52) U.S. Cl. ..... 315/291; 315/224; 315/307; 315/247; 315/277; 345/102; 345/212; 363/41; 363/43

(58) Field of Classification Search ..... 315/276, 315/277, 282, 247, 224, 209 R, 244, 291, 315/307; 345/102, 87, 52, 212; 363/21.09, 363/40, 21.1, 41, 43, 78
See application file for complete search history.

(56) References Cited

U.S. PATENT DOCUMENTS 6,442,048 B1 8/2002 Sun et al.
6,636,190 B2 * 10/2003 Hirakata et al. ..... 345/74.1
6,812,916 B2 * 11/2004 Hwang ..... 345/102
2006/0284568 A1 * 12/2006 Chang et al. ..... 315/282

FOREIGN PATENT DOCUMENTS

JP 2000306689 11/2000

* cited by examiner

*Primary Examiner*—Haissa Philogene
(74) *Attorney, Agent, or Firm*—Lowe Hauptman Ham & Berner

(57) ABSTRACT

A backlight inverter using electromagnetic induction and full-wave rectification at a second side of a main transformer includes a drive unit for generating a first voltage and a main transformer having first and second coils. The main transformer converts the first voltage from the drive unit into a second voltage, and outputs an AC current of the second voltage to both ends of a lamp. An auxiliary transformer has a first auxiliary coil formed on a current line connecting between the second coil of the main transformer and the lamp and a second auxiliary coil inductively coupled with the first auxiliary coil. The auxiliary transformer detects the current flowing to the lamp. A full-wave rectifier rectifies the current detected by the auxiliary transformer, and a drive controller controls the PWM duty of the first voltage based on a voltage from the full-wave rectifier.

8 Claims, 7 Drawing Sheets

(a)

(b)

(c)

BACKLIGHT INVERTER FOR INDUCTIVELY DETECTING CURRENT

CLAIM OF PRIORITY

This application claims the benefit of Korean Patent Application No. 2006-62943 filed on Jul. 5, 2006, in the Korean Intellectual Property Office, the disclosure of which is incorporated herein by reference.

BACKGROUND OF THE INVENTION

1. Field of the Invention

The present invention relates to a backlight inverter for a Liquid Crystal Display (LCD) such as a large screen LCD TV and a large screen LCD monitor, and more particularly to a one-lamp and one-transformer type backlight inverter which can precisely detect a lamp current by using electromagnetic induction and full-wave rectification at a second side of a main transformer in order to control the lamp current to be constant and stable, thereby maintaining luminous uniform.

2. Description of the Related Art

As LCD-TV and LCD monitor markets are growing gradually, more lamps are mounted on a backlight unit along followed by increase in size and length. Therefore, driving techniques for the lamps are also changing variously.

According to such trend, conventional LCD backlight inverters are also grouped into one type applicable to small screen LCDs having a screen size of about 17 inches and the other type applicable to large screen LCDs having a screen size exceeding 17 inches.

An inverter applied to a small screen LCD generates a first lamp voltage of about 500 Vrms to 800 Vrms, and a feedback node for detecting and stabilizing a lamp current is formed at a cold end of the lamp.

On the other hand, a backlight inverter applied to a large screen uses a long straight lamp or U-shaped lamp relatively longer than that of the conventional small screen LCD backlight inverter. In addition, regarding that such a long lamp also requires a second voltage of about 1 KVrms, there are still several technical problems to solve in order to drive the long lamp properly. One of the problems is how to detect a current flowing through the lamp and how to control the lamp in a constant current mode.

In particular, the backlight inverter for a large screen LCD uses two transformers to drive one lamp. Since hot and cold ends of the lamp are not clearly discriminated from each other, and current sensing at the cold end is not preferable unlike the small screen LCD inverter, the backlight inverter controls lamp current via another route. One of such conventional backlight inverters is shown in FIG. 1.

FIG. 1 is a block diagram illustrating a conventional backlight inverter for an LCD.

Referring to FIG. 1, a conventional backlight inverter for a large screen LCD includes first and second transformers 21 and 22 in order to actuate a U-shaped lamp 30 which needs a high first voltage of about 1 KVrms. Each of the first and second transformers 21 and 22, upon receiving a square wave signal from each of first and second drive units 11 and 12, steps up and converts it into an AC signal. Then, the first and second transformers 21 and 22 supply first and second AC driving currents AS1 and AS2 to both sides of the lamp 30. Here, the first and second AC driving currents are out of phase with each other.

In order to control the currents flowing through the lamp 30 steady, the backlight inverter also includes a current detector 40 with feedback nodes connected to the ground side of a second coil of the first and second transformers 21 and 22, respectively. The current detector 40 detects and feeds back a voltage induced by a current flowing through the second side of a corresponding transformer.

Based upon the currents detected by the current detector 40, the drive controller 50 controls the first and second drive units 11 and 12 to flow constant driving voltages through the lamp 30.

FIG. 2 is a diagram illustrating a driving voltage waveform of the backlight inverter shown in FIG. 1.

Referring to FIG. 2, first and second AC driving currents AS1 and AS2 supplied from the first and second transformers 21 and 22 to the lamp 30 are out of phase with each other. This out-of-phase status allows the driving currents to flow through the lamp 30.

In order to detect such driving currents, the current detector 40 includes a first resistor R1 connected to the ground side of the second coil of the first transformer 21 and a second resistor R2 connected to the ground side of the second coil of the second transformer 22.

The conventional backlight inverter for a large screen LCD as stated above needs two transformers to operate one U-shaped lamp 30, which disadvantageously raises cost. Such a disadvantage is an obstacle against miniaturization and low cost of products. Therefore, the conventional driving method type is not appropriate in the aspect of size and cost.

As an approach to overcome such a disadvantage, a new type has been researched and developed, which can drive two U-shaped lamps and four linear lamps. In the one-transformer and two-lamp type or one-transformer and four-lamp type, a considerably high voltage ranging from 750 V to 1,000 V is supplied to the lamps. Therefore, it is required to detect a current flowing through the lamps according to the turn ratio of first and second coils L21 and L22.

SUMMARY OF THE INVENTION

The present invention has been made to solve the foregoing problems of the prior art and therefore an object of certain embodiments of the present invention is to provide a one-lamp and one-transformer type backlight inverter which can precisely detect a lamp current by using electromagnetic induction and full-wave rectification at a second side of a main transformer in order to control the lamp current to be constant and stable, thereby maintaining luminous uniform.

According to an aspect of the invention, there is provided a backlight inverter for inductively detecting a current, comprising: a drive unit for generating a first voltage controlled in a PWM mode; a main transformer including first and second coils, the main transformer converting the first voltage from the drive unit into a second voltage according to a turn ratio between the first and second coils, and outputting the second voltage in the form of an AC driving current to both ends of a lamp, the both ends of the lamp connected to both ends of the second coil; an auxiliary transformer including a first auxiliary coil formed on a current line connecting between the second coil of the main transformer and the lamp and a second auxiliary coil inductively coupled with the first auxiliary coil, the auxiliary transformer detecting the current flowing to the lamp according to the turn ratio between the first and second auxiliary coils; a full-wave rectifier for rectifying the current detected by the auxiliary transformer; and a drive controller for controlling the PWM duty of the first voltage based on a voltage from the full-wave rectifier.

Preferably, the full-wave rectifier includes: a first passive device connected between one end of the second auxiliary coil of the auxiliary transformer and a ground part, the first passive device converting a current from the second auxiliary coil into a voltage; a second passive device connected between the other end of the second auxiliary coil of the auxiliary transformer and the ground part, the second passive device converting a current from the second auxiliary coil into a voltage; a first rectifying diode for rectifying the voltage converted by the first passive device; and a second rectifying diode for rectifying the voltage converted by the second passive device.

Preferably, the first passive device comprises a first resistor, and the second passive device comprises a second resistor.

Preferably, the full-wave rectifier further includes: a first protection diode connected to the first resistor in parallel, and having a cathode connected to a positive end of the first resistor and an anode connected to a negative end of the first resistor; and a second protection diode connected to the second resistor in parallel, and having a cathode connected to a positive end of the second resistor and an anode connected to a negative end of the second resistor.

Preferably, the first passive device comprises a first capacitor, and the second passive device comprises a second capacitor.

Preferably, the full-wave rectifier includes: a first reference potential diode connected between one end of the second auxiliary coil of the auxiliary transformer and a ground part, the first reference potential diode setting a first reference potential for converting a current from the second auxiliary coil into a voltage; a second reference potential diode connected between the other end of the second auxiliary coil of the auxiliary transformer and the ground part, the second reference potential diode setting a second reference potential for converting a current from the second auxiliary coil into a voltage; a first rectifying diode for rectifying the current from the one end of the second auxiliary coil based on the first reference potential set by the first reference potential diode; a second rectifying diode for rectifying the current from the other end of the second auxiliary coil based on the second reference potential set by the second reference potential diode; and an output passive device for converting the currents outputted from the first and second rectifying diodes, which are added together and full-wave rectified, into a voltage.

Preferably, the output passive device comprises a resistor or a capacitor.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described more fully hereinafter with reference to the accompanying drawings, in which like reference signs are used to designate like components throughout.

Figure 1:
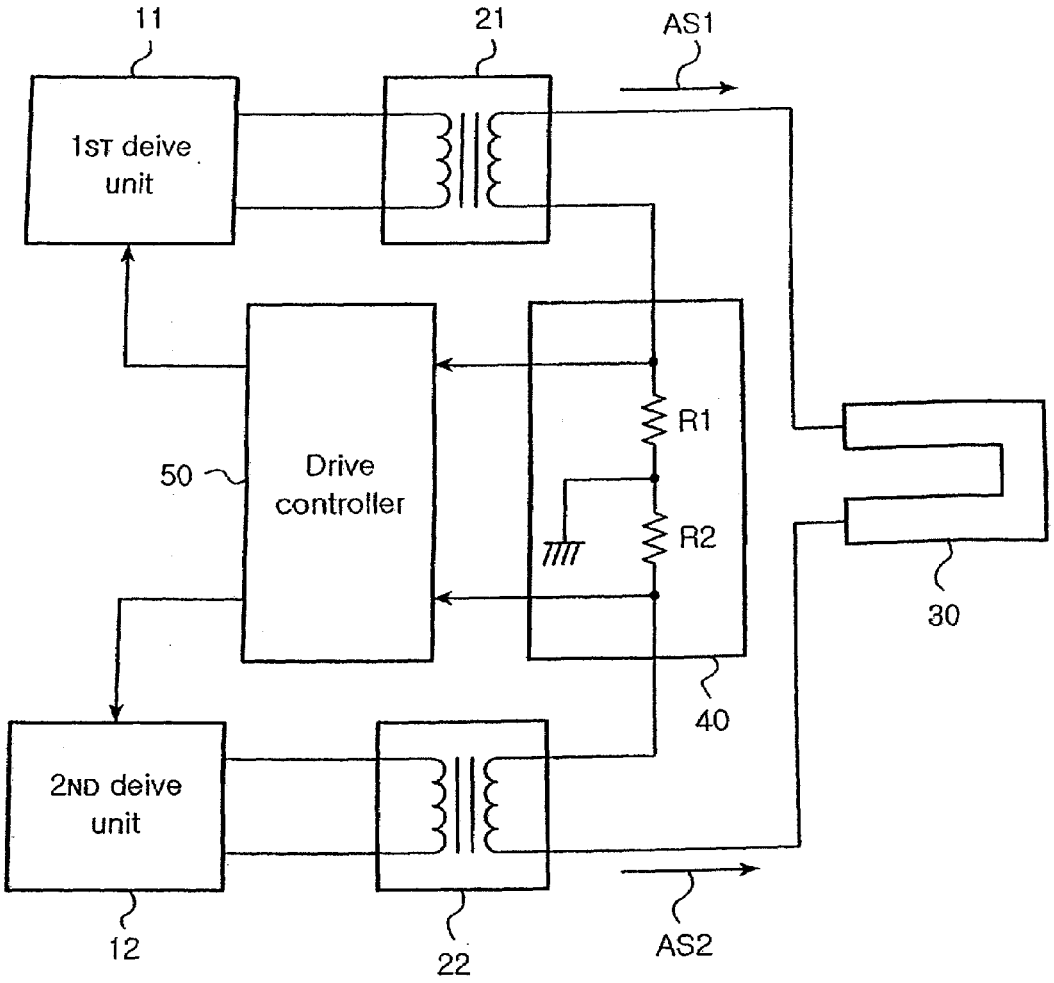
PRIOR ART FIG. 1
FIG. 1 is a block diagram illustrating a conventional backlight inverter for an LCD.
Figure 2:
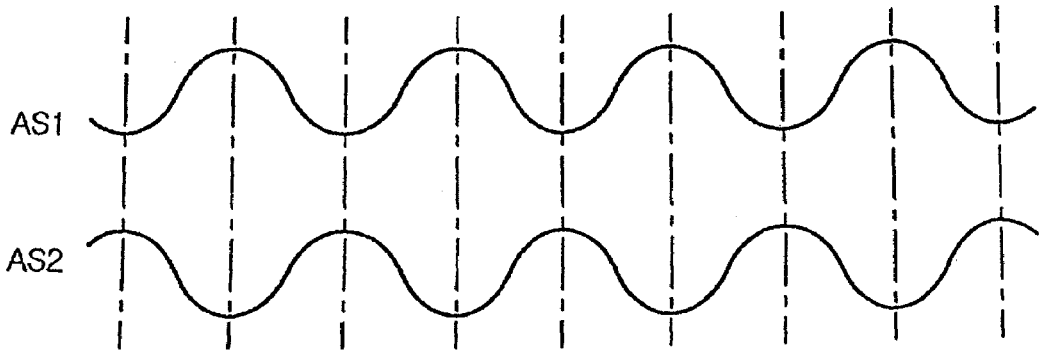
PRIOR ART FIG. 2
FIG. 2 is a diagram illustrating a driving voltage waveform of the backlight inverter shown in FIG. 1.
Figure 3:
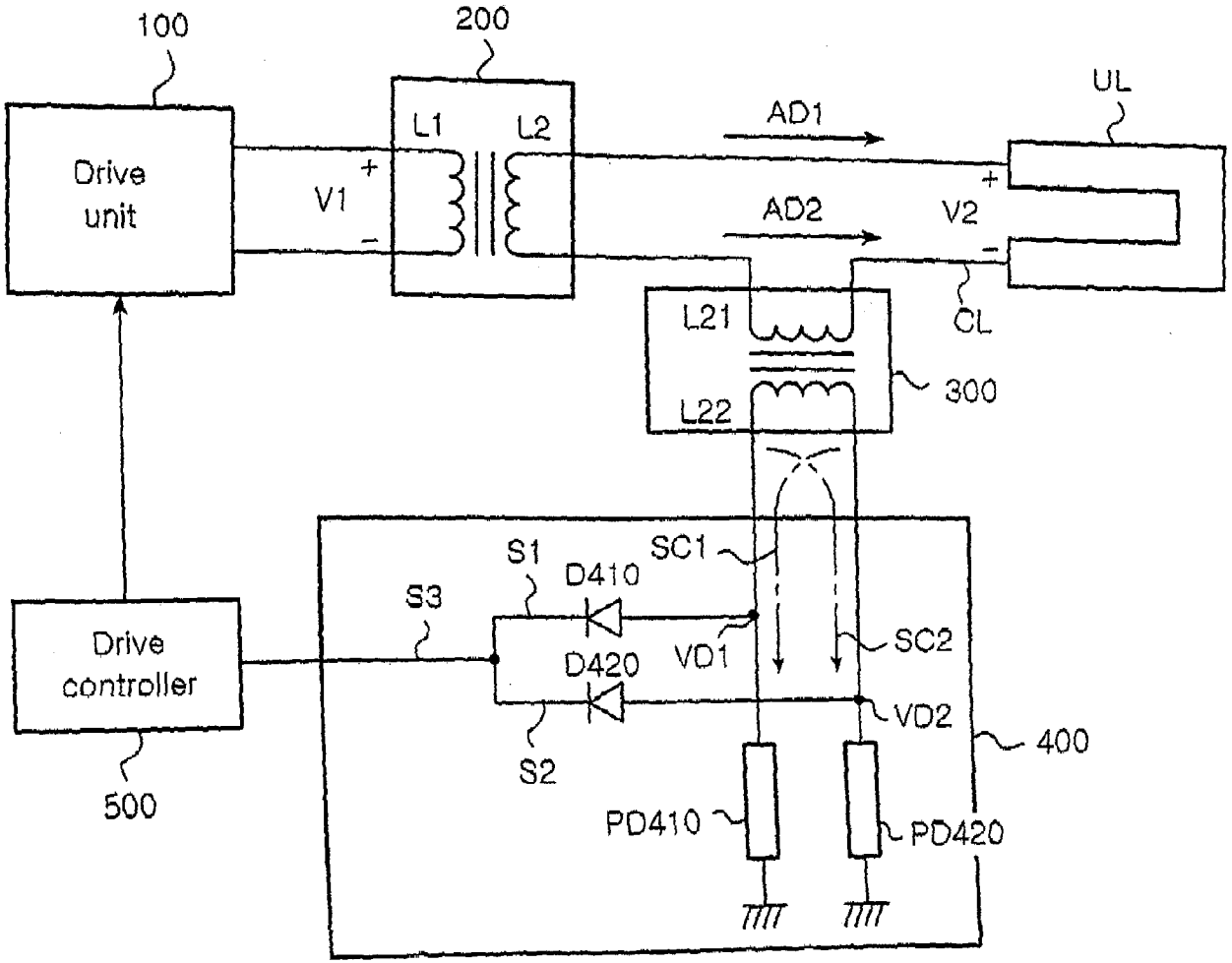
FIG. 3 is a block diagram illustrating a backlight inverter for a large screen LCD of the invention.

FIG. 3 is a block diagram illustrating a backlight inverter for a large screen LCD of the invention.

The backlight inverter of the invention as shown in FIG. 3 adopts a driving mechanism which drives two U-shaped lamps or four linear lamps with one transformer, and more particularly, inductively detects a current flowing through the lamp and full-wave rectifies the current to drive the lamps. The backlight inverter includes a drive unit 100, a main transformer 200, an auxiliary transformer 300, a full-wave rectifier 400 and a drive controller 500.

Referring to FIG. 3, the drive unit 100 is constructed to generate a staircase waveform of first voltage V1 that is controlled in a Pulse Waveform Modulation (PWM) mode under the control of the drive controller 500.

The main transformer 200 includes a first coil L1 and a second coil L2, and is adapted to convert the first voltage V1 supplied from the drive unit 100 into a second voltage V2 according to the turn ratio between the first and second coils L1 and L2, and to output the second voltage V2 to a U-shaped lamp UL having both ends connected to both ends of the second coil L2, respectively.

The turn ratio between the first and second coils L1 and L2 is varied according to lamp type applied, and more particularly according to rated current or voltage required by the applied lamp.

The auxiliary transformer 300 of the invention includes a first auxiliary coil L21 formed on a current line CL connecting the second coil L2 with the lamp UL and a second auxiliary coil L22 inductively coupled with the first auxiliary coil L21, and is adapted to detect a current flowing through the lamp UL according to the turn ratio of the first and second auxiliary coils L21 and L22. Using such an induction type transformer advantageously leads to detection of a desired current without being influenced by a high lamp voltage.

The full-wave rectifier 400 is adapted to full-wave rectify the current detected by the auxiliary transformer 300, and includes first and second passive devices PD410 and PD420 and first and second rectifying diodes D410 and D420. The first passive device PD410 is connected between one end of the second auxiliary coil L22 of the auxiliary transformer 300 and a ground part, and is adapted to convert the current from the second auxiliary coil L22 into a voltage. The second passive device PD420 is connected between the other end of the second auxiliary coil L22 of the auxiliary transformer 300 and the ground part, and is adapted to convert the current from the second auxiliary coil 300 into the voltage. The first rectifying diode D410 rectifies the voltage converted by the first passive device PD410, and the second rectifying diode D420 rectifies the voltage converted by the second passive device PD420.

The drive controller 500 is adapted to compare the voltage from the full-wave rectifier 400 with a preset internal voltage, and based on the comparison result, control PWM duty of the first voltage V1 of the drive unit 100.

Figure 4:
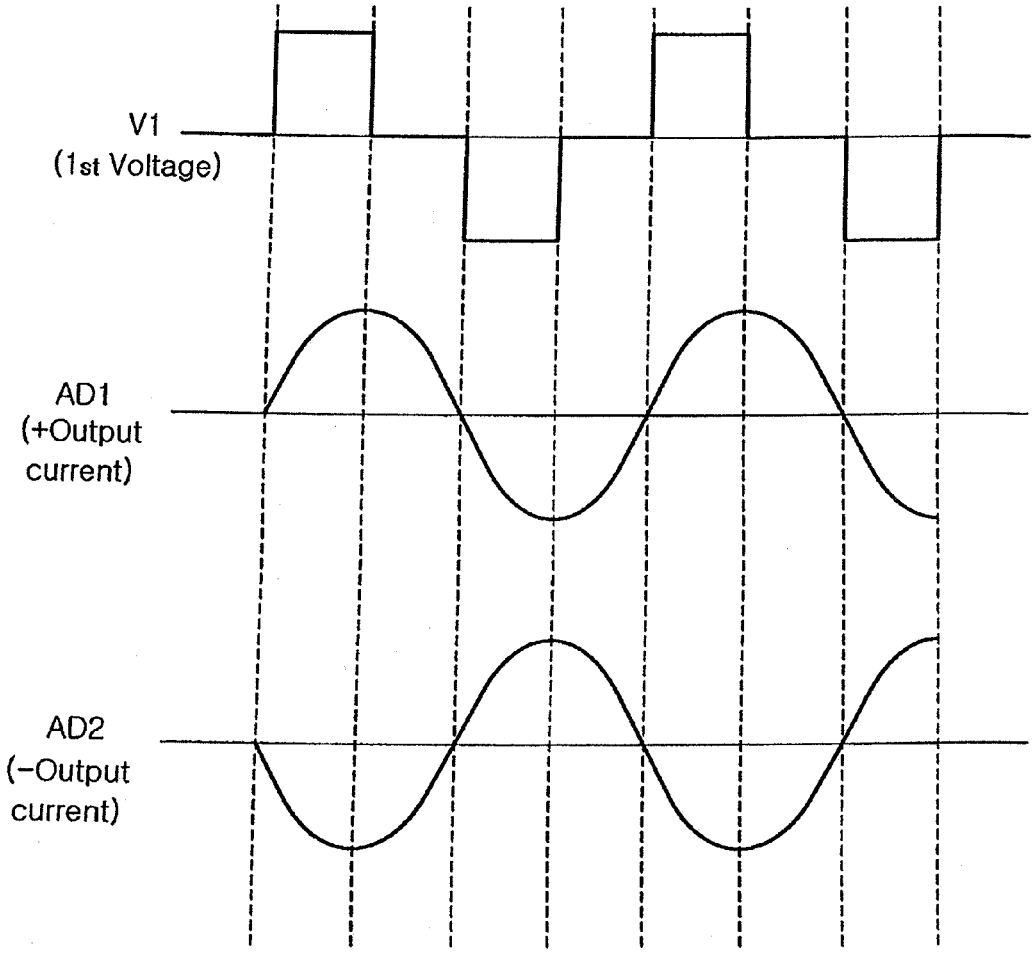
FIG. 4 is a diagram illustrating waveforms of a first voltage and output currents of a main transformer shown in FIG. 3.

FIG. 4 is a diagram illustrating waveforms of a first voltage and output currents of the main transformer 200 shown in FIG. 3. In FIG. 4, the reference sign V1 indicates a first voltage supplied from the drive unit 100 to the main transformer 200, and the reference signs AD1 and AD2 indicate output currents from the main transformer 200, respectively.

Figure 5:
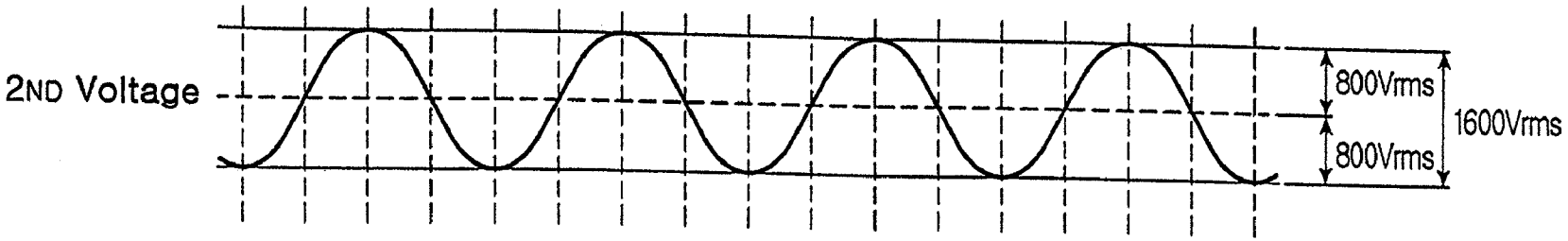
FIG. 5 is a diagram illustrating a waveform of a second voltage of a U-shaped lamp of the invention.

FIG. 5 is a diagram illustrating a waveform of a second voltage of the U-shaped lamp UL of the invention, detected at both ends of the U-shaped lamp UL. In FIG. 5, the voltage waveform is a waveform of the second voltage V2 outputted from the main transformer 200. The second voltage V2 is approximately 1,600 Vrms with a positive voltage of approximately 800 Vrms and a negative voltage of approximately 800 Vrms.

Detailed embodiments of the full-wave rectifier 400 will now be described with reference to (a) to (c) in FIG. 6.

Figure 6:
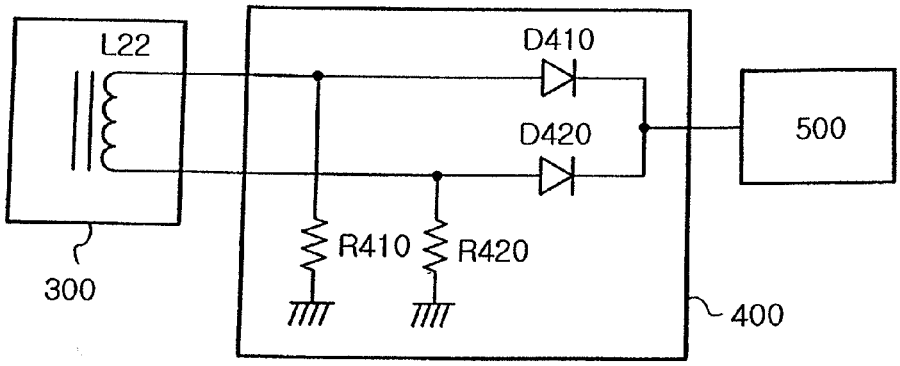
FIG. 6 is circuit diagrams each illustrating an exemplary full-wave rectifier of the invention.
Figure 6:
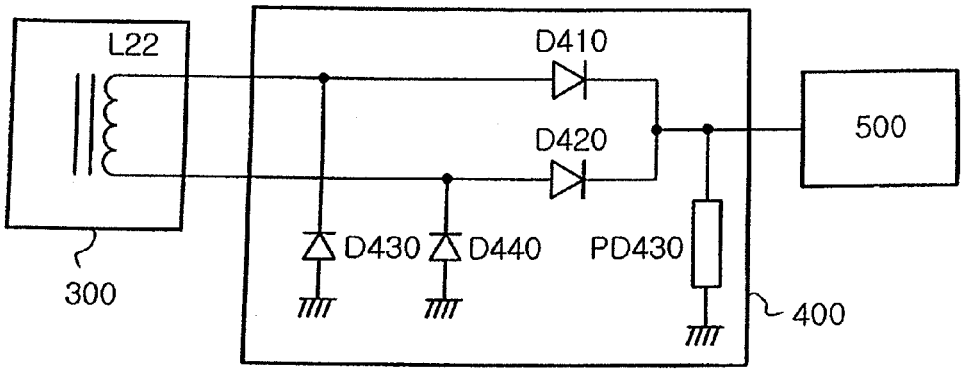
Figure 6:
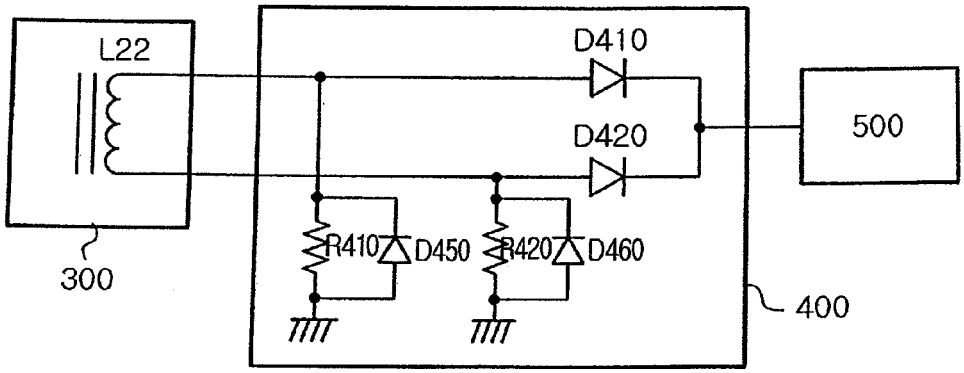

FIG. 6 is circuit diagrams each illustrating an exemplary embodiment of the full-wave rectifier 400 of the invention. In (a) of FIG. 6, the full-wave rectifier 400 includes first and second resistors R410 and R420 constituting the first and second passive devices PD410 and PD420.

Referring to (b) of FIG. 6, the full-wave rectifier 400 includes first and second protection diodes D430 and D440. The first protection diode D430 is connected to the first resistor R410 in parallel, and has a cathode connected to a positive end of the first resistor R410 and an anode connected to a negative end of the first resistor R420. The second protection diode D440 is connected to the second resistor R40 in parallel, and has a cathode connected to a positive end of the second resistor R420 and an anode connected to a negative end of the second resistor R420.

Alternatively, the full-wave rectifier 400 may have first and second capacitors constituting the first and second passive devices PD410 and PD420, respectively.

Referring to (c) of FIG. 6, the full-wave rectifier 400 includes first and second reference potential diodes D409 and D419, first and second rectifying diodes D410 and D420, and an output passive device PD430. The first reference potential diode D409 is connected between one end of the second auxiliary coil L22 of the auxiliary transformer and the ground part, and sets a first reference potential for converting a current from the second auxiliary coil L22 into a voltage. The second reference potential diode D419 is connected between the other end of the second auxiliary coil L22 of the auxiliary transformer 300 and the ground part, and sets a second reference voltage for converting a current from the second auxiliary coil L22 into a voltage. The first rectifying diode D410 rectifies the current supplied from the one end of the second auxiliary coil L22 based on the first reference potential set by the first reference potential diode D409. The second rectifying diode D420 rectifies the current supplied from the other end of the second auxiliary coil L22 based on the second reference potential set by the second reference potential diode D419. The output passive device 430, when outputs of the first and second rectifying diodes D410 and D420 are added together and full-wave rectified, converts the full-wave rectified current into a voltage.

Here, the output passive device PD430 may be comprised of a resistor or capacitor.

Following detailed description will be given of the operations and effects of the present invention with reference to the accompanying drawings.

The backlight inverter according to certain embodiments of the invention is adequate for a large screen LCD TV or large screen LCD monitor adopting a CCFL with high luminous efficiency, and will be described with reference to FIGS. 3 to 7.

Referring to FIG. 3, in the backlight inverter of this invention, the drive unit 100 generates a staircase waveform of first voltage V1 that is controlled in a PWM mode under the control of the drive controller 500, and provides the first voltage V1 to the main transformer 200. The first voltage V1 has a staircase waveform as shown in FIG. 4.

Referring to FIGS. 3 and 4, the main transformer 200 converts the first voltage V1 supplied from the drive unit 100 into a second voltage V2 according to the turn ratio between the first and second coils L1 and L2, and outputs the second voltage V2 to the U-shaped lamp UL connected by the both ends to those of the second coil L2, respectively.

Here, the second voltage V2 applied to the both ends of the U-shaped lamp UL has a high voltage on the order of 1,600 Vrms as shown in FIG. 5.

In case of direct detection, the high current flowing through the lamp UL may damage a detection device such as a resistor when directly detected by the detection device. Accordingly, the backlight inverter according to this embodiment uses the electromagnetic induction type auxiliary transformer 300, as shown in FIG. 3, to detect the current flowing through the lamp according to the turn ratio between the first and second auxiliary coils L21 and L22.

Referring to FIG. 4, the first voltage V1 from the drive unit 100 has a staircase waveform controlled in the PWM mode, and is converted into the second voltage V2 by the main transformer 200. The second voltage V2 is outputted from the ends of the main transformer 200 as output currents AD1 and AD2, which are then supplied to the ends of the lamp UL, respectively.

Referring to FIG. 5 also, the second voltage V2 outputted from the main transformer has a positive voltage of 800 Vrms and a negative voltage of 800 Vrms with a sum of about 1,600 Vrms. The second voltage V2 as high as this value is supplied to the lamp UL.

Now a description will be made of a process of detecting the current flowing through the lamp UL according to the above-mentioned electromagnetic induction.

Referring to FIG. 3, as the first auxiliary coil L21 of the auxiliary transformer 300 is formed on the current line CL, a current flowing from the second coil L2 of the main transformer 200 to the lamp UL through the current line CL is induced from the first auxiliary coil L21 to the second auxiliary coil L22.

That is, the current between the main transformer 200 and the lamp UL flows through the first auxiliary coil L21, and is induced to the second auxiliary coil L22. Then, induced currents flow to the both ends of the second auxiliary coil L22.

When the current flowing to the lamp UL is induced at the first auxiliary coil L21 to the second auxiliary coil L22, the induced currents flow to the both ends of the second auxiliary coil L22 with a virtual ground located in the center thereof. The currents flowing to the both ends of the second auxiliary coil L22 are full-wave rectified by the full-wave rectifier 400 described below.

Describing the operations of the full-wave rectifier 400 with reference to FIGS. 3 to 5, the first passive device PD410 converts the current from the second auxiliary coil L22 into a voltage, and the second passive device PD420 converts the current from the second auxiliary coil 300 into the voltage.

Here, the voltage detected by the first passive device PD410 is rectified by the first rectifying diode D410, and the voltage detected by the second passive device PD420 is rectified by the second rectifying diode D420.

The outputs from the first and second rectifying diodes D410 and D420 are added together and full-wave rectified.

Then, the full-wave rectifier 400, upon full-wave rectifying the current detected by the auxiliary transformer 300, supplies the rectified current to the drive controller 500.

The first and second passive devices PD410 and PD420 may be constructed of a resistor or capacitor. The passive devices constructed of resistors will be described with reference to FIG. 6.

Now the full-wave rectifier 400 will be described with reference to (a) to (c) of FIG. 6.

Describing the full-wave rectifier 400 with reference to (a) of FIG. 6, the current flowing between the main transformer 200 and the lamp UL is induced to the second auxiliary coil L22 of the auxiliary transformer 300 according to the turn ratio between the first and second auxiliary coils L21 and L22. The induced current is divided into two flows each directed to each of both ends of the second auxiliary coil L22.

In this case, the first resistor R410 of the full-wave rectifier 400 converts a current SC1 flowing between one end of the second auxiliary coil L22 of the auxiliary transformer 300 and the ground part into a voltage VD1. The first resistor R420 of the full-wave rectifier 400 converts a current SC2 flowing between the other end of the second auxiliary coil L22 of the auxiliary transformer 300 and the ground part into a voltage VD2.

Figure 7:
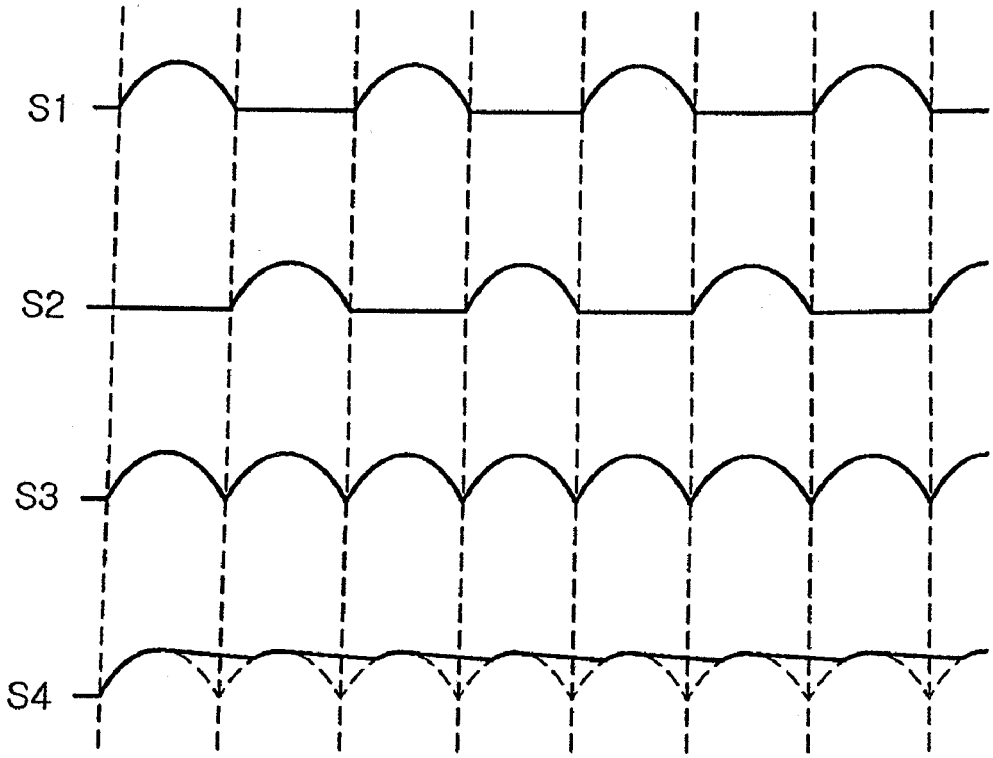
FIG. 7 is a diagram illustrating voltage waveforms of the full-wave rectifier of the invention.

The voltage VD1 converted by the first resistor R410 is half-wave rectified by the first rectifying diode D410 to have a voltage waveform S1 as shown in FIG. 7. The voltage VD2 converted by the second resistor R420 is half-wave rectified by the first rectifying diode D420 to have a voltage waveform S2 as shown in FIG. 7. The first and second voltage waveforms S1 and S2 each half-wave rectified by the first rectifying diode D420 are added together and make a full-wave rectified voltage waveform S3 as shown in FIG. 7.

When the voltage waveform S3 is smoothened, it is converted to have a DC voltage waveform S4 as shown in FIG. 7, and then supplied to the drive controller 500.

The full-wave rectifier 400 will now be described with reference to (b) of FIG. 6.

In the full-wave rectifier 400 as shown in (b) of FIG. 6, when the first protection diode D430 is connected to the first resistor R410 in parallel and the second protection diode D440 is connected to the second resistor R420 in parallel, the protection diodes D430 and D440 can react against excessive voltage such as surge to protect devices including the first and second resistors R410 and R420.

On the other hand, the full-wave rectifier 400 may be constructed into a form as shown in (c) of FIG. 6, which will be described below.

Referring to (c) of FIG. 6, the first reference potential diode D409 of the full-wave rectifier 400 sets a first reference potential for converting a current from the second auxiliary coil L22 into a first voltage, and the second reference potential diode D419 of the full-wave rectifier 400 sets a second reference potential for converting a current from the second auxiliary coil L22 into a second voltage.

The first rectifying diode D410 of the full-wave rectifier 400 rectifies a current supplied from one end of the second auxiliary coil L22 based on the first reference potential set by the first reference potential diode D409. The second rectifying diode D420 rectifies a current supplied from the other end of the second auxiliary coil L22 based on the second reference potential set by the second reference potential diode D419. The output passive device 430 of the full-wave rectifier 400, when outputs of the first and second rectifying diodes D410 and D420 are added together and full-wave rectified, converts the full-wave rectified current into a voltage.

Here, the output passive device PD430 may be comprised of a resistor or capacitor, which can also convert the full-wave rectified current from the first and second rectifying diodes D410 and D420 into a voltage.

Then, the drive controller 500 controls the PWM duty of the first voltage V1 of the drive unit 100 based on the voltage from the full-wave rectifier 400. In response to the control of the drive controller 500, the drive unit 100 controls the duty of the first voltage in the PWM mode, which is a well known technology in the art and thus not described in detail. This as a result ensures a constant current to flow through the lamp UL.

As set forth above, the full-wave rectifier 400 cooperates with the auxiliary transformer 300 to make the voltage detected by the full-wave rectifier 400 greater than that half-wave rectified. This as a result can improve current detection sensitivity and reduce the turn number of the second coil of the auxiliary transformer 300 thereby decreasing the size thereof.

With the auxiliary transformer and the full-wave rectifier according to certain embodiments of the invention, a current flowing through the lamp can be detected in the form of a stable DC voltage. Then, a driving current of the lamp can be controlled as a constant current without fluctuations so that the luminous of the lamp can be maintained at a stable level.

The following detailed description will present a preferred embodiment of the invention in reference to the accompanying drawings, in which well-known functions or constructions will not be described in detail since they would unnecessarily obscure the understanding/concept of the invention.

According to certain embodiments of the invention as set forth above, a backlight inverter for a LCD such as a large screen LCD TV and a large screen LCD monitor, in particular, a one-lamp and one-transformer type backlight inverter can precisely detect a lamp current by using electromagnetic induction and full-wave rectification at a second side of a main transformer in order to control the lamp current to be constant and stable, thereby maintaining luminous uniform.

What is claimed is:

1. A backlight inverter for inductively detecting a current, comprising:

a drive unit for generating a first voltage controlled in a Pulse Width Modulation (PWM) mode;

a main transformer including first and second coils, the main transformer converting the first voltage from the drive unit into a second voltage according to a turn ratio between the first and second coils, and outputting the second voltage in the form of an AC driving current to both ends of a lamp, the both ends of the lamp connected to both ends of the second coil;

an auxiliary transformer including a first auxiliary coil formed on a current line connecting between the second coil of the main transformer and the lamp and a second auxiliary coil inductively coupled with the first auxiliary coil, the auxiliary transformer detecting the current flowing to the lamp according to the turn ratio between the first and second auxiliary coils;

a full-wave rectifier for rectifying the current detected by the auxiliary transformer; and a drive controller for controlling the PWM duty of the first voltage based on a voltage from the full-wave rectifier.

2. The backlight inverter of claim 1, wherein the full-wave rectifier includes:

a first passive device connected between one end of the second auxiliary coil of the auxiliary transformer and a ground part, the first passive device converting a current from the second auxiliary coil into a voltage;

a second passive device connected between the other end of the second auxiliary coil of the auxiliary transformer and the ground part, the second passive device converting a current from the second auxiliary coil into a voltage;

a first rectifying diode for rectifying the voltage converted by the first passive device; and a second rectifying diode for rectifying the voltage converted by the second passive device.

3. The backlight inverter of claim 2, wherein the first passive device comprises a first resistor, and the second passive device comprises a second resistor.

4. The backlight inverter of claim 3, wherein the full-wave rectifier further includes:

a first protection diode connected to the first resistor in parallel, and having a cathode connected to a positive end of the first resistor and an anode connected to a negative end of the first resistor; and a second protection diode connected to the second resistor in parallel, and having a cathode connected to a positive end of the second resistor and an anode connected to a negative end of the second resistor.

5. The backlight inverter of claim 2, wherein the first passive device comprises a first capacitor, and the second passive device comprises a second capacitor.

6. The backlight inverter of claim 1, wherein the full-wave rectifier includes:

a first reference potential diode connected between one end of the second auxiliary coil of the auxiliary transformer and a ground part, the first reference potential diode setting a first reference potential for converting a current from the second auxiliary coil into a voltage;

a second reference potential diode connected between the other end of the second auxiliary coil of the auxiliary transformer and the ground part, the second reference potential diode setting a second reference potential for converting a current from the second auxiliary coil into a voltage;

a first rectifying diode for rectifying the current from the one end of the second auxiliary coil based on the first reference potential set by the first reference potential diode;

a second rectifying diode for rectifying the current from the other end of the second auxiliary coil based on the second reference potential set by the second reference potential diode; and an output passive device for converting the currents outputted from the first and second rectifying diodes, which are added together and full-wave rectified, into a voltage.

7. The backlight inverter of claim 6, wherein the output passive device comprises a resistor.

8. The backlight inverter of claim 6, wherein the output passive device comprises a capacitor.

* * * * *